US008484927B2

(12) United States Patent
Nguyen

(10) Patent No.: US 8,484,927 B2
(45) Date of Patent: Jul. 16, 2013

(54) RIGHT-ANGLE GIRDER TIE

(75) Inventor: Hien Nguyen, San Jose, CA (US)

(73) Assignee: Simpson Strong-Tie Company, Inc, Pleasanton, CA (US)

( * ) Notice: Subject to any disclaimer, the term of this patent is extended or adjusted under 35 U.S.C. 154(b) by 503 days.

(21) Appl. No.: 11/217,957

(22) Filed: Aug. 31, 2005

(65) Prior Publication Data

US 2007/0044421 A1 Mar. 1, 2007

(51) Int. Cl.
*E04B 1/38* (2006.01)

(52) U.S. Cl.
USPC ..... 52/714; 52/715

(58) Field of Classification Search
USPC ..... 52/693, 715, 714, 712, 127.1, 655.1, 52/285.3, 489.1, 92.2, 93.1; 403/230, 232.1
See application file for complete search history.

(56) References Cited

U.S. PATENT DOCUMENTS

| | | | | |
|---|---|---|---|---|
| 1,423,991 | A | 7/1922 | Brooks | |
| 1,943,036 | A * | 1/1934 | O'Reilly | 52/236.6 |
| 2,191,979 | A | 2/1940 | Bierbach | |
| 2,831,222 | A * | 4/1958 | Anderson | 52/489.1 |
| 3,187,389 | A | 6/1965 | Anderson | |
| 4,106,257 | A * | 8/1978 | Gilb | 52/693 |
| 4,417,431 | A * | 11/1983 | Commins et al. | 52/715 |
| 4,589,792 | A * | 5/1986 | Niziol | 403/11 |
| 4,817,359 | A | 4/1989 | Colonias | |
| 4,995,605 | A * | 2/1991 | Conville | 52/770 |
| 5,027,573 | A * | 7/1991 | Commins et al. | 52/489.2 |
| 5,042,217 | A * | 8/1991 | Bugbee et al. | 52/643 |
| 5,253,465 | A * | 10/1993 | Gilb | 52/643 |
| 5,442,887 | A * | 8/1995 | Welsh | 52/92.2 |
| 5,488,810 | A * | 2/1996 | Horton | 52/715 |
| 5,555,694 | A * | 9/1996 | Commins | 52/702 |
| 5,653,079 | A * | 8/1997 | Loeffler et al. | 52/712 |
| 5,901,522 | A * | 5/1999 | Slater | 52/641 |
| 5,966,893 | A | 10/1999 | Quillin | |
| 6,076,325 | A | 6/2000 | Sluiter | |
| 6,088,988 | A * | 7/2000 | Sahramaa | 52/639 |
| 6,230,467 | B1 * | 5/2001 | Leek | 52/702 |
| 6,254,306 | B1 * | 7/2001 | Williams | 403/403 |
| 6,446,409 | B1 * | 9/2002 | Emerson | 52/712 |
| 6,513,298 | B2 | 2/2003 | Rassel | |
| 6,560,943 | B1 * | 5/2003 | Leek et al. | 52/715 |
| 6,763,634 | B1 * | 7/2004 | Thompson | 52/92.2 |
| 6,840,020 | B2 * | 1/2005 | Leek et al. | 52/712 |
| 6,993,880 | B2 | 2/2006 | Cameron et al. | |
| 6,993,882 | B2 * | 2/2006 | Crawford et al. | 52/696 |
| 7,104,024 | B1 * | 9/2006 | diGirolamo et al. | 52/710 |

(Continued)

FOREIGN PATENT DOCUMENTS

| | | |
|---|---|---|
| EP | 1 760 213 | 3/2007 |
| EP | 1 760 213 B1 | 5/2011 |

OTHER PUBLICATIONS

Simpson Strong-Tie Company, Inc., "ZS Slotted Z Clip," www.strongtie.co.uk, (Nov. 2002) Staffordshire, U.K.

(Continued)

*Primary Examiner* — Jessica Laux
(74) *Attorney, Agent, or Firm* — James R. Cypher; Charles R. Cypher

(57) ABSTRACT

A connector for joining a supported member to a supporting member is formed with a series of angularly-joined flanges. The flanges are substantially planar and are substantially vertically oriented, when joining the supported member to the supporting member. The connector allows the end of a supported truss to be connected to a vertical member in the open web of a supporting truss.

12 Claims, 9 Drawing Sheets

U.S. PATENT DOCUMENTS

| | | | | |
|---|---|---|---|---|
| 2002/0112439 | A1* | 8/2002 | Rosas | 52/712 |
| 2002/0124483 | A1* | 9/2002 | Rosas | 52/92.2 |
| 2003/0079433 | A1* | 5/2003 | Leek et al. | 52/712 |
| 2006/0026907 | A1* | 2/2006 | Gilstrap et al. | 52/92.2 |

OTHER PUBLICATIONS

Simpson Strong-Tie Company, Inc., "Wood Construction Connectors," Catalog C-2003, pp. 39, 40, 41, 42, 43, 44, 73, 119, 134, (C-2003), Simpson Strong-Tie Company, Inc. USA.

NUCONSTEEL A Nucor Company, "Nutruss," http://nuconsteel.com/pages/projects_nutruss_overview.html ; http://nuconsteel.com/pages/projects_nutruss_technical.html ; (2005) Nuconsteel.

Simpson Strong-Tie Company, Inc., Catalog C-2004, 2003, p. 113, Pleasanton, California.

Extended European Search Report, European Patent Application 06254541.3, issued Dec. 16, 2008.

* cited by examiner

RIGHT-ANGLE GIRDER TIE

BACKGROUND

This invention relates to a connector for joining structural members. The connector of the present invention has particular application as a sheet metal hanger for use in a hip roof, joining supported jack trusses to supporting girder trusses. A hip roof has sloped ends as well as sloped sides. The roof rises by inclining planes from all four sides of the building of which it is a part. The line where an adjacent sloping side and sloping end meet is generally called the "hip." The four hips generally run from a corner of the building to the peak of the roof at a 45 degree angle. The hips are not merely lines, but are either rafters or trusses. The ends of the roof can be built up from flat-topped trusses that step down from the roof peak. Alternatively, the ends of the roof can be made from sloping jack trusses that run parallel to the roof peak and which are supported by the end wall of the building and by a girder truss. The ends of the roof can also be made with a combination of stepped-down flat-topped trusses and jack trusses, in which case the flat-topped truss closest to the end wall is the girder truss supporting the jack trusses. Generally, any truss that does not span from wall to wall is referred to as a jack truss, so the truss on the hip line could be referred to as a jack truss. However, for the sake of clarity, the truss on the hip line will be referred to as a hip truss in the present application. In addition to the jack trusses that run parallel to the roof peak and are supported by a girder truss, there generally are shorter jack trusses that are supported by the hip trusses where the hip trusses approach the corners of the roof and building.

In the particular application for joining multiple members, the framing members may be lumber or wood trusses, but in the most preferred form the framing members are hollow steel trusses. The connection is most typically made at the junction of the supporting girder truss and one hip truss framing member.

Prior art U.S. Pat. No. 5,253,465, granted to Tyrell T. Gilb teaches a sheet metal connector for making multiple truss connections. U.S. Pat. No. 4,817,359, granted to Karen Colonias also teaches a similar connection with a sheet metal hanger; however, neither of these patents teach the improved connector of the present invention.

SUMMARY OF THE INVENTION

The improved connector of the present invention provides a connector with a series of angularly-joined flanges. In the most preferred embodiments, the flanges are substantially planar. In the connection formed with the connector of the present invention, the flanges are substantially vertically oriented. The connector allows the end of a supported truss to be connected to a vertical member in the open web of a supporting truss. The formed connection is preferably at a 90 degree angle. At least some of the flanges are preferably reinforced by shallow embossments. The embossments reinforce the flanges against deformation so that they remain generally planar.

When the connector is formed from a sheet metal blank that is bent and formed into its final configuration, the embossments, along with the outlines of the flanges and fastener opening, are created while the blank is still flat, after which the flanges are bent out of the blank, creating the junctures between them.

The connector of the present invention is specifically designed to join a jack truss to a supporting girder truss that has an open web.

An advantage of the present invention is that it better joins members because it fastens to each of the supporting and supported members with fasteners that enter the members from at least two different principle angles or directions, so that the fasteners, attaching the connector to a member, are not all withdrawn in the same direction to disassemble the connection. This is especially helpful for hollow metal members.

An advantage of the present invention is that it is economically formed from a substantially rectangular blank that wastes virtually no material in the manufacturing process.

DESCRIPTION OF THE PREFERRED EMBODIMENTS OF THE INVENTION

Figure 2:
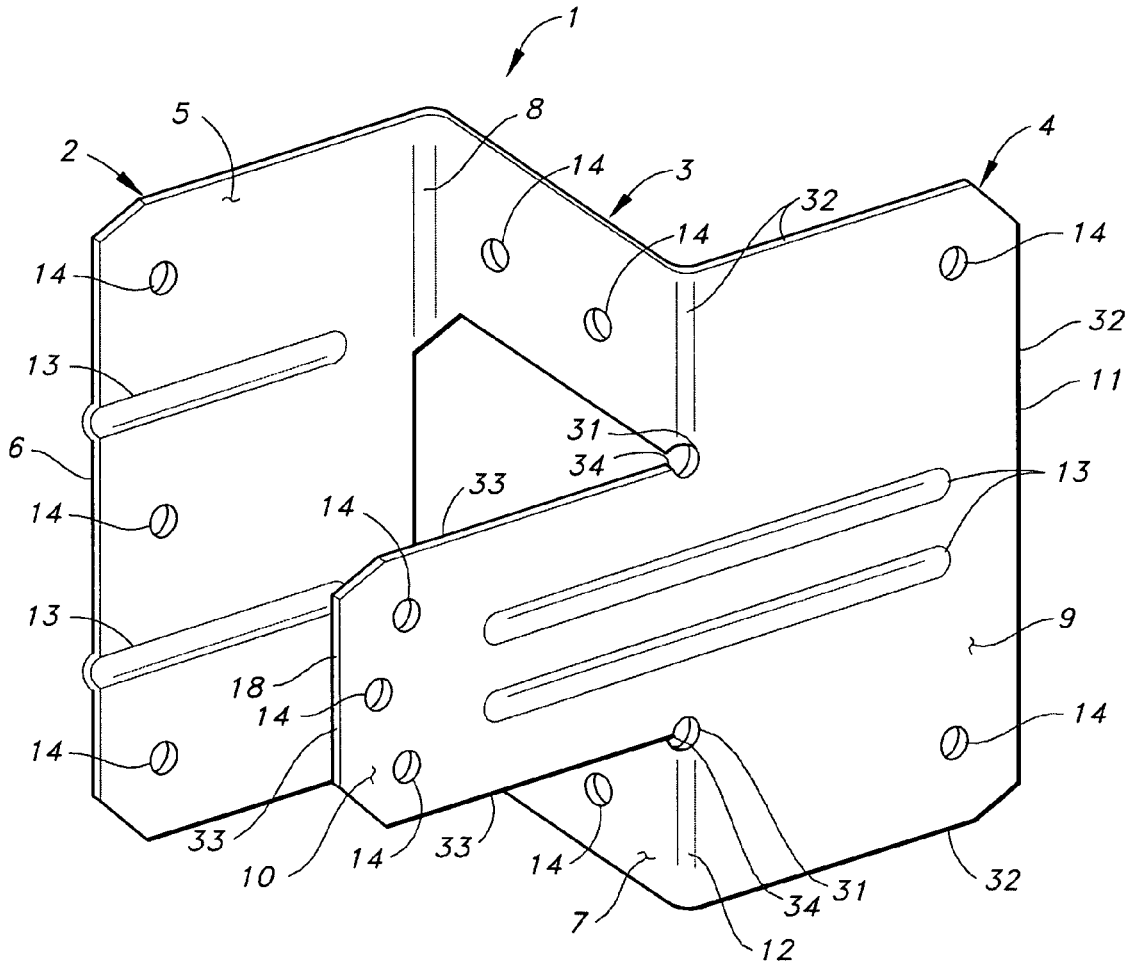
FIG. 2 is a perspective view of a right angle girder tie connector formed according to the present invention.
Figure 3:
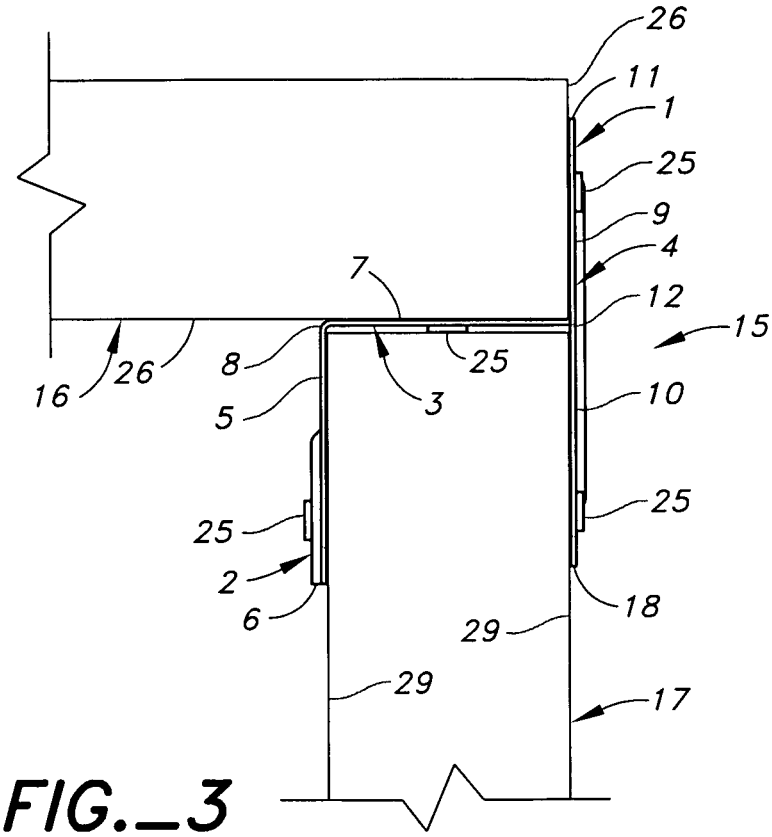
FIG. 3 is a top plan view of a portion of the jack truss to girder truss connection, illustrating a first jack truss and a first girder truss, both wood members, connected by a connector formed according to the present invention.
Figure 4:
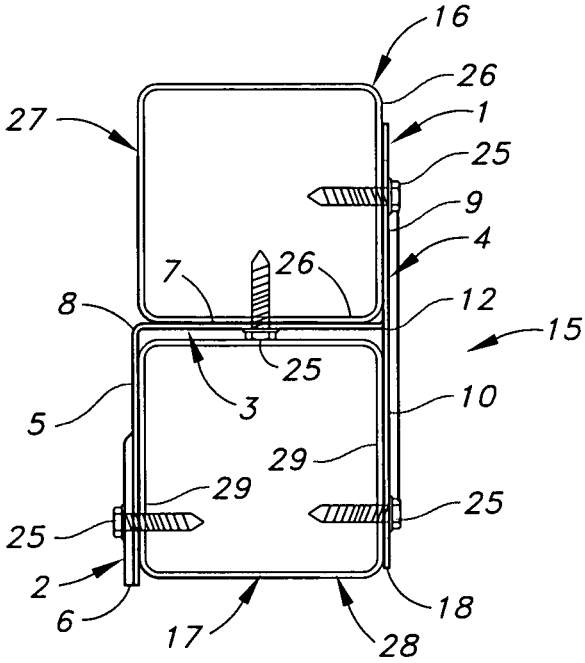
FIG. 4 is a top plan view of a portion of another jack truss to girder truss connection using a connector formed according to the present invention. The view is similar to that shown in FIG. 3 except that the connected members are hollow metal members.
Figure 5:
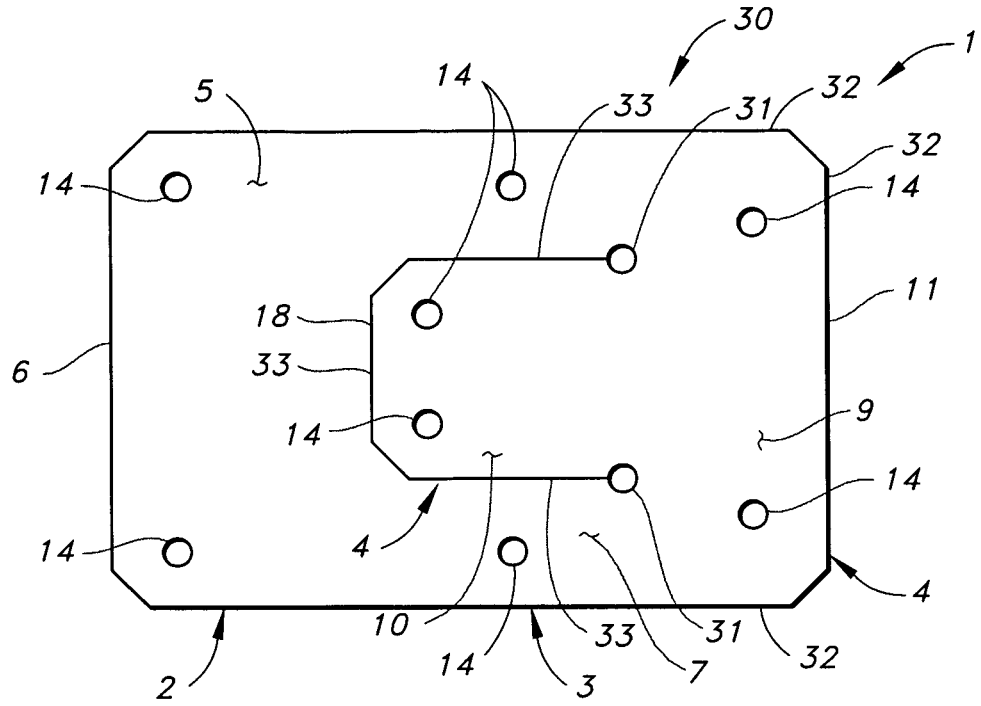
FIG. 5 is a top plan view of a sheet metal blank without reinforcing embossments prior to bending from which a sheet metal connector formed according to the present invention is constructed.

As shown in FIG. 2, at its most basic, the present invention is a connector 1 comprising a first flange 2, a second flange 3, angularly joined to the first flange 2, and a third flange 4, angularly joined to the second flange 3. In making a connection according to the present invention, the first flange 2 and a portion of the third flange 4 attach to a supported structural member 17, and the second flange 3 and a portion of the third flange 4 attach to the supporting structural member 16.

As shown in FIG. 2, in the preferred embodiment, the first flange 2 has a first substantially planar portion 5 and a first edge 6. The second flange 3 has a first substantially planar portion 7. The second flange 3 is angularly joined to the first flange 2 at a first juncture 8 that is at least partially opposite the first edge 6 of the first flange 2 across the first flange 2. The third flange 4 has a first substantially planar portion 9 and a second substantially planar 10 portion integrally joined to the first substantially planar portion 9 in substantially the same plane as the first substantially planar portion 9. There is a first edge 11 on the first substantially planar portion 9, and a second edge 18 on the second substantially planar portion 10. The first substantially planar portion 9 of the third flange 4 is angularly joined to the second flange 3 at a second juncture 12 that is at least partially opposite the first edge 11 of the third flange 4 across the first substantially planar portion 9 of the third flange 4. The second juncture 12 is at least partially opposite the first juncture 8 across the second flange 3. The second substantially planar portion 10 of the third flange 4 extends past the second juncture 12. The second substantially planar portion 10 of the third flange 4 extends away from the first edge 11 of the third flange 4. At least part of the second edge 18 of the third flange 4 is oriented in the same direction as the first edge 6 of the first flange 2, and at least part of the second edge 18 of the third flange 4 is oriented in substantially the opposite direction from the first edge 11 of the third flange 4.

As is also shown in FIG. 2, preferably, the first flange 2 has at least one reinforcing embossment 13. In both preferred embodiments shown in the drawing figures, the first flange 2 has two reinforcing embossments 13. The third flange 4 preferably has at least one reinforcing embossment 13. In the first preferred embodiment, shown in FIGS. 5-8, the third flange 4 has one embossment 13. In the second preferred embodiment, shown in FIGS. 9-12, the third flange 4 has two embossments 13.

Preferably, any reinforcing embossment 13 in the first flange 2 is elongated and oriented substantially perpendicular to the first juncture 8. The reinforcing embossments 13 in the third flange 4 are preferably elongated, oriented substantially perpendicular to the second juncture 12, and span from the first substantially planar portion 9 of the third flange 4 to the second substantially planar portion 10 of the third flange 4.

Preferably, the first flange 2, the second flange 3 and the third flange 4 each have a plurality of fastener openings 14.

The second flange 3 is preferably orthogonal to the first flange 2 and to the third flange 4, and the first flange 2 and the third flange 4 occupy substantially parallel planes. In this preferred arrangement, the second flange 3 defines a plane that divides or transects the third flange splitting it into the second substantially planar portion 10 of the third flange 4 and the first substantially planar portion 9 of the third flange 4. Thus, the second substantially planar portion 10 of the third flange 4 extends from the second juncture 12, and past the plane of division created by the second flange 3 in one direction toward the edge 18, and the first substantially planar portion 9 of the third flange 4 extends past the plane of division created by the second flange 3 in the opposite direction from the second substantially planar portion 10 of the third flange 4 towards edge 11. The first flange 2 extends from the plane of division created by the second flange 3 in the same direction as the second substantially planar portion 10 of the third flange 4.

Figure 1:
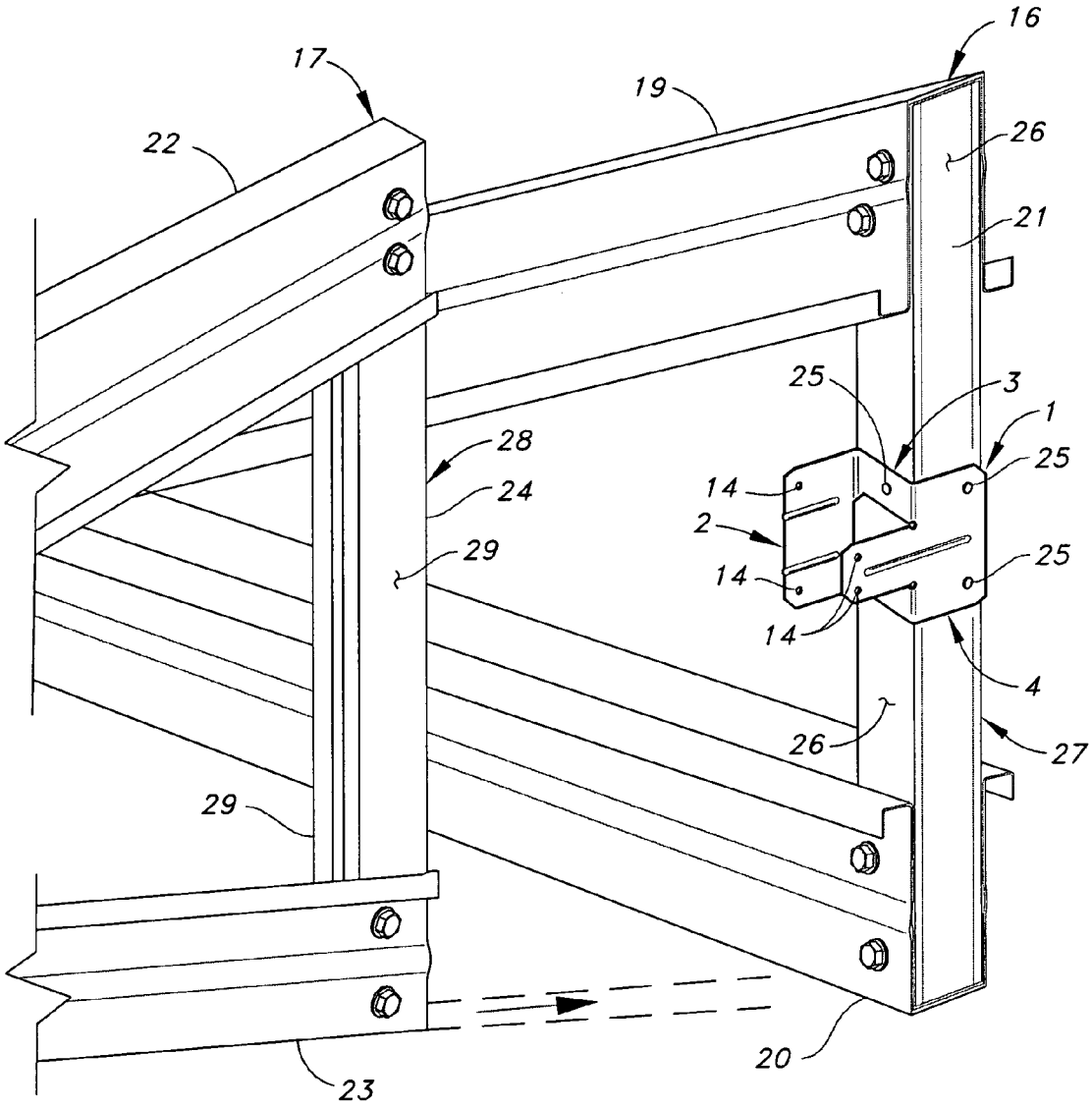
FIG. 1 is a perspective view of the present invention used as a jack truss to girder truss connector.

As shown in FIG. 1, preferably, the connector 1 of the present invention connects a supporting structural member 16 and a supported structural member 17. The supporting structural member 16 is preferably fastened to the second flange 3 and the first substantially planar portion 9 of the third flange 4. Preferably, the supported structural member 17 is fastened to the first flange 2 and the second substantially planar portion 10 of the third flange 4. The connector 1 will function if reversed, but that is not the preferred orientation.

The supporting structural member 16 is preferably a supporting truss 16, and the supported structural member 17 is preferably a supported truss 17. Preferably, the supporting truss 16 has a top chord 19, a bottom chord 20, and at least one web member 21 extending between the top chord 19 and the bottom chord 20. The connector 1 preferably interfaces with the web member 21 of the supporting truss 16. Preferably, the supported truss 17 has a top chord 22, a bottom chord 23 and an end member 24 extending between the top chord 22 and the bottom chord 23. The connector 1 preferably interfaces with the end member 24 of the supported truss 17.

Preferably, the supporting structural member 16 and the supported structural member 17 are made primarily of metal. More preferably, the supporting structural member 16 and the supported structural member 17 are made primarily of hollow steel. In the most preferred embodiment, the connector 1 of the present invention is used to form a connection 15 between trusses of the NuconSteel NuTruss system.

The supporting structural member 16 and the supported structural member 17 are preferably fastened to the connector 1 with separate fasteners 25. Preferably, the separate fasteners 25 are screws 25. In fact, the connection 15 could be formed without separate fasteners 25, if the connector 1 were formed with integral mechanical fasteners 25, or if adhesives or welding were used to fasten the connector 1 to the structural members 17 and 16. If the connector 1 were used with wood members, the preferred fasteners 25 would be self-drilling wood screws of the kind exemplified by the Simpson Strong-Tie SDS screw. If the connector 1 is used to form a connection 15 with metal members, the preferred fastener 25 would be self-drilling metal screws, which install quickly and easily with an automatic driver, most preferably #10 self-drilling metal screws, a standard in the industry.

Preferably, the connection 15 of the present invention is formed by driving a plurality of the screws 25 through the second flange 3 into the supporting structural member 16, driving a plurality of the screws 25 through the first substantially planar portion 9 of the third flange 4 into the supporting structural member 16, driving a plurality of the screws 25 through the first flange 2 into the supported structural member 17, and driving a plurality of the screws 25 through the second substantially planar portion 10 of the third flange 4 into the supported structural member 17.

As shown in FIG. 1, when the connection 15 of the present invention is formed, the web member 21 of the supporting structural member 16 is preferably part of a web 27 between the top chord 19 and the bottom chord 20 of the supporting structural member 16. Preferably, the web member 21 has first and second substantially planar sides 26. The first side 26 of the web member 21 is preferably within the web 27 and the second side 26 of the web member 21 faces out of the web 27. Preferably, the second flange 3 interfaces with the second side 26 of the web member 21. The first substantially planar portion 9 of the third flange 4 preferably interfaces with the first side 26 of the web member 21. Preferably, the end member 24 of the supported structural member 17 is part of a web 28 between the top chord 22 and the bottom chord 23 of the supported structural member 17. The end member 24 preferably has first and second substantially planar sides 29. Preferably, the first side 29 of the end member 24 faces out of the web 28 and the second side 29 of the end member 24 faces out of the web 28 in the opposite direction from the first side 29 of the end member 24. The first flange 2 preferably interfaces with the first side 29 of the end member 24. Preferably, the second substantially planar portion 10 of the third flange 4 interfaces with the second side 29 of the end member 24.

When forming the connection 15 of the present invention with the preferred webs 27 and 28, a plurality of the screws 25 is preferably driven through the second flange 3 into the second side 26 of the web member 21. A second plurality of the screws 25 is preferably driven through the first substantially planar portion 9 of the third flange 4 into the first side 26 of the web member 21. Then, a third plurality of the screws 25 is preferably driven through the first flange 2 into the first side 29 of the end member 24, and a fourth plurality of the screws 25 is driven through the second substantially planar portion 10 of the third flange 4 into the second side 29 of the end member 24.

Figure 6:
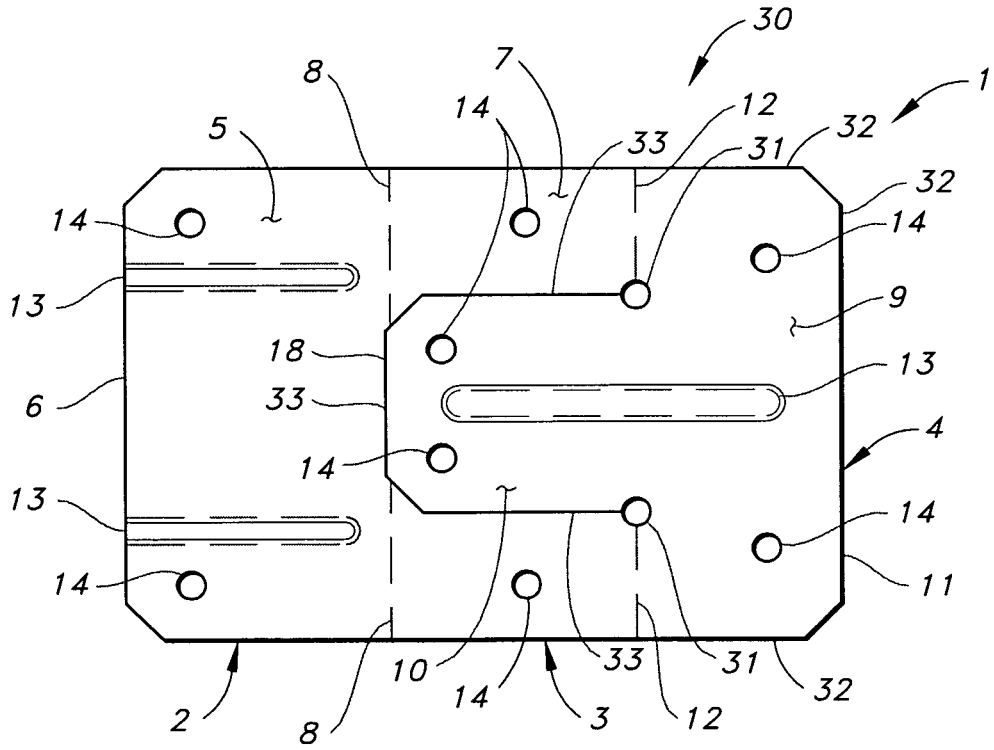
FIG. 6 is a top plan view of a sheet metal blank with reinforcing embossments prior to bending from which a sheet metal connector formed according to the present invention is constructed.
Figure 7:
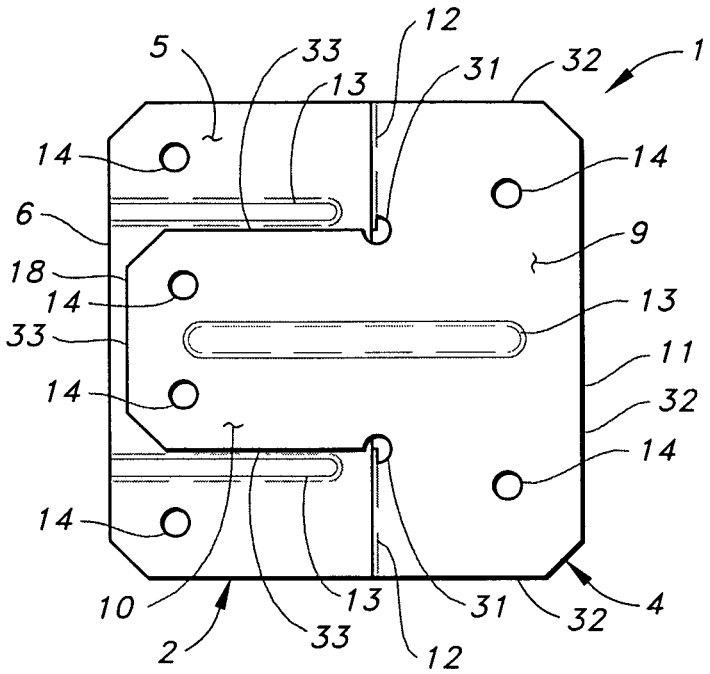
FIG. 7 is an end elevation view of a sheet metal connector formed according to the present invention.
Figure 8:
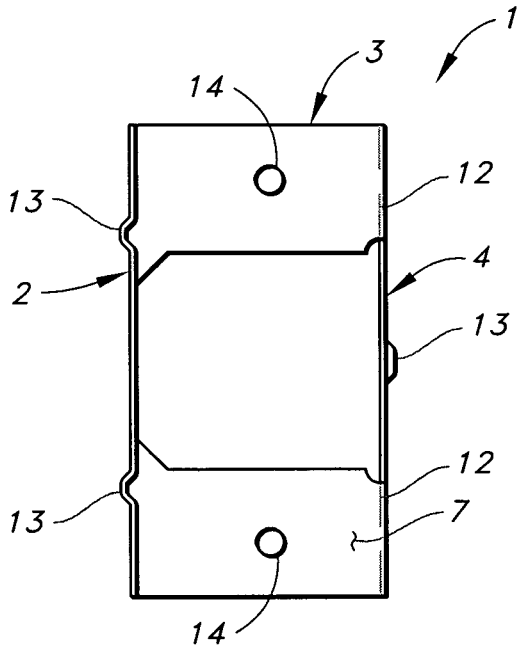
FIG. 8 is a side elevation view of a sheet metal connector formed according to the present invention.
Figure 9:
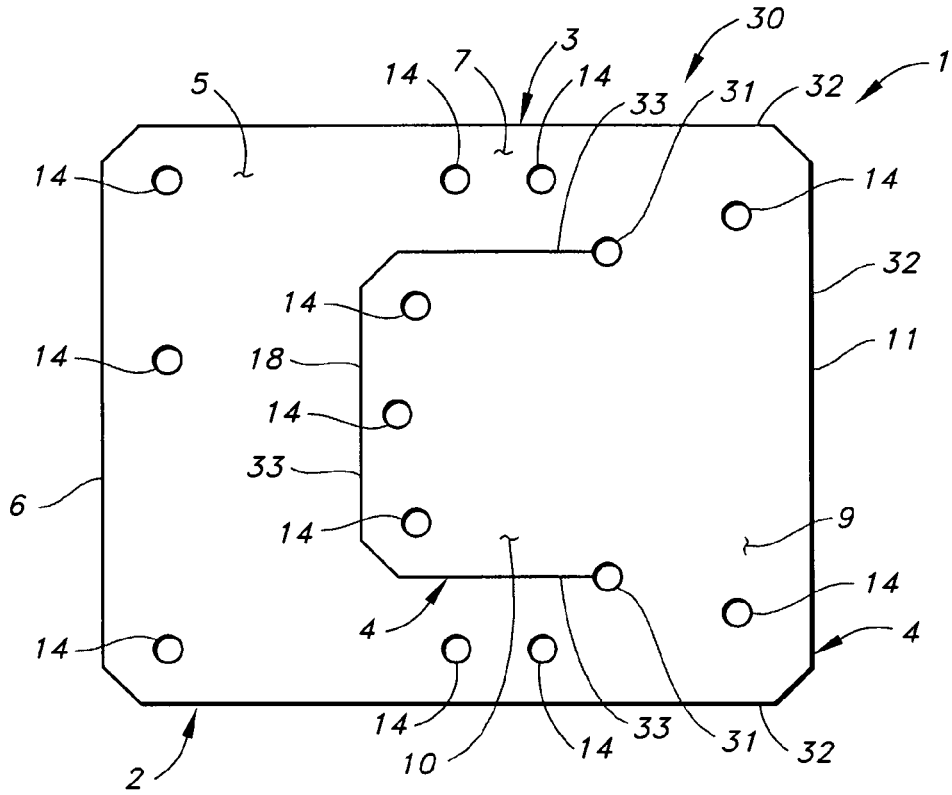
FIG. 9 is a top plan view of a sheet metal blank without reinforcing embossments prior to bending from which an alternate preferred embodiment of a sheet metal connector formed according to the present invention is constructed.
Figure 10:
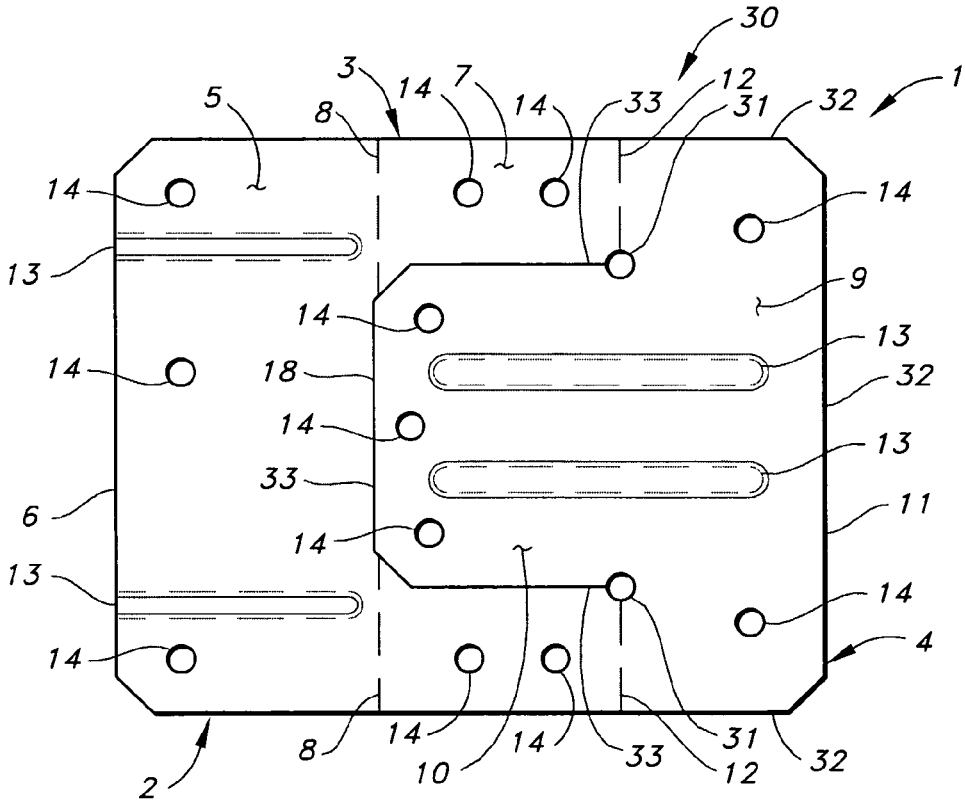
FIG. 10 is a top plan view of a sheet metal blank with reinforcing embossments prior to bending from which an alternate preferred embodiment of a sheet metal connector formed according to the present invention is constructed.
Figure 11:
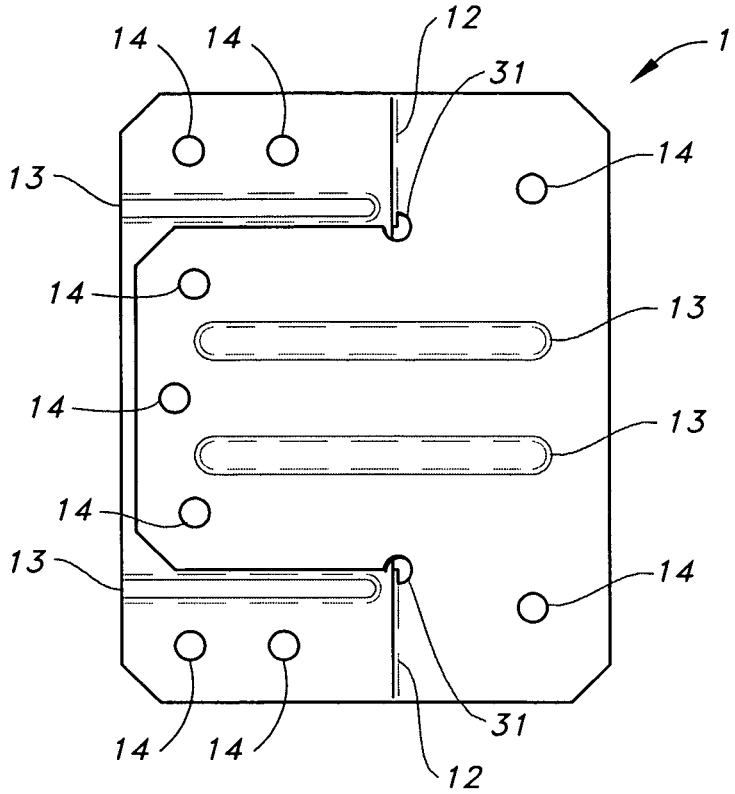
FIG. 11 is an end elevation view of an alternate preferred embodiment of a sheet metal connector formed according to the present invention.
Figure 12:
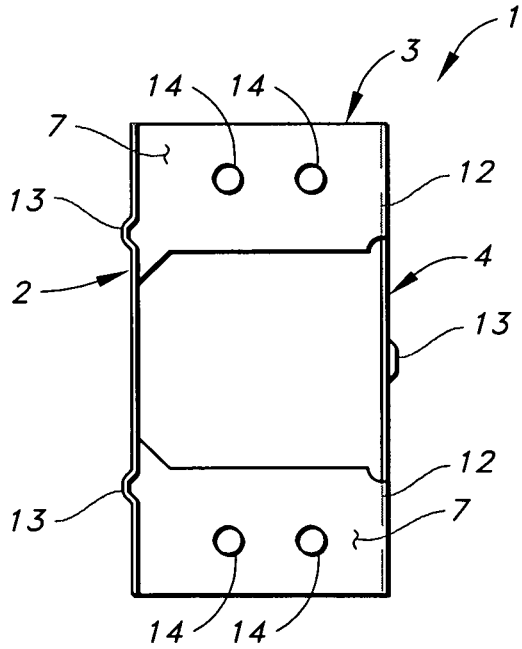
FIG. 12 is a side elevation view of an alternate preferred embodiment of a sheet metal connector formed according to the present invention.
Figure 13:
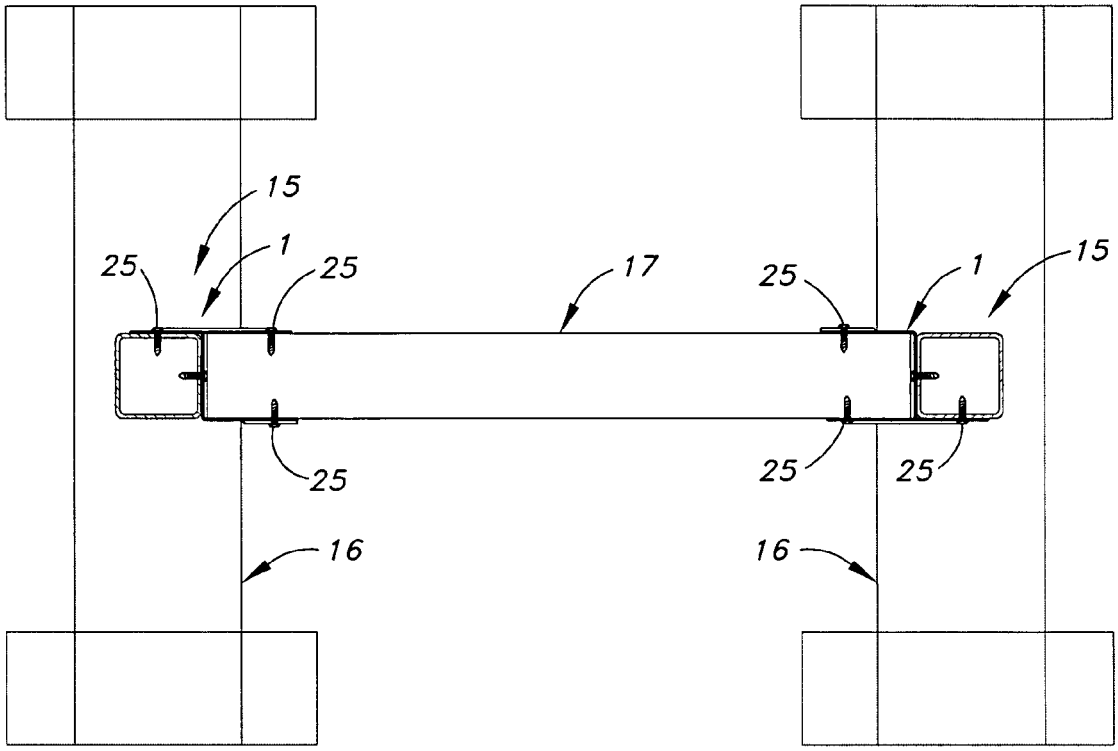
FIG. 13 is a top plan view of a short truss supported by two girder trusses, using two connectors formed according to the present invention, in which the connected members are hollow metal members.
Figure 14:
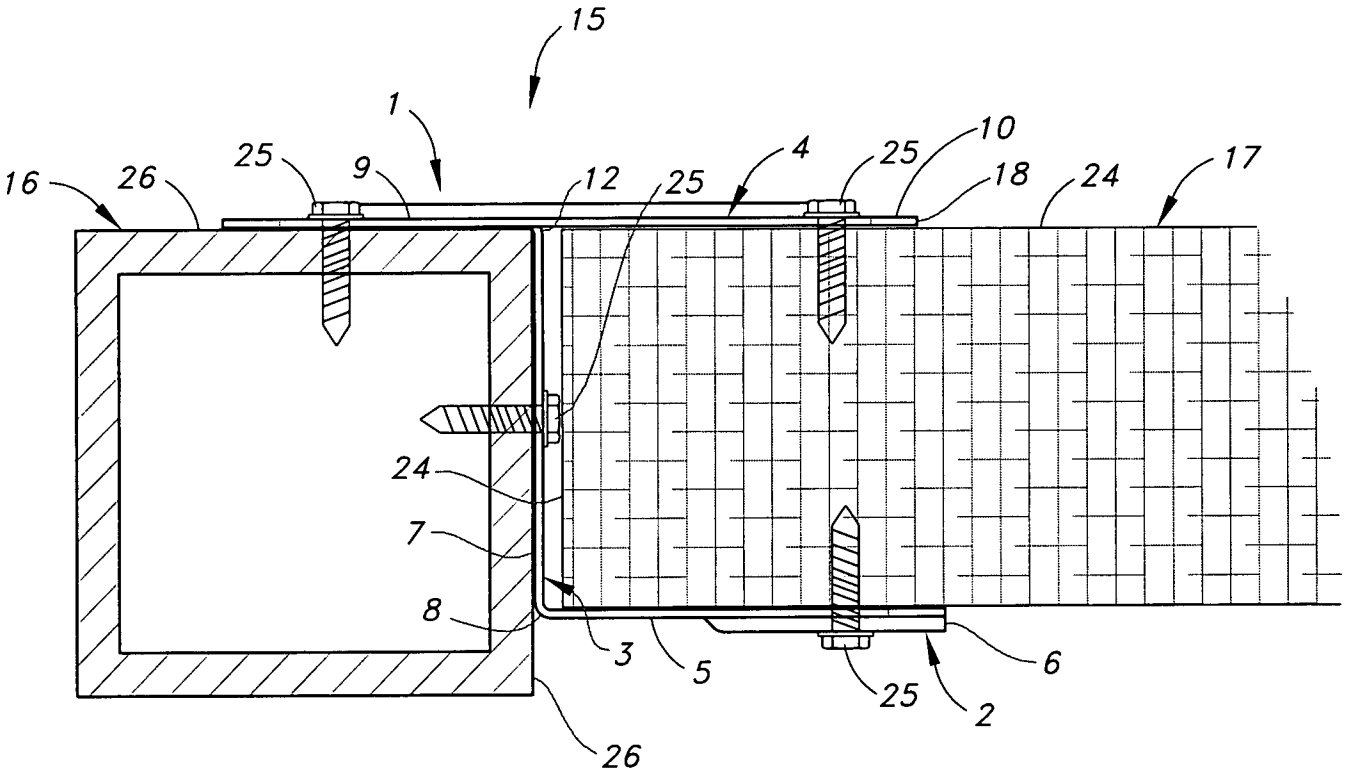
FIG. 14 is a top plan view of a portion of the jack truss to girder truss connection showing the use of the preferred fasteners.

As shown in FIG. 6, the connector 1 of the present invention is preferably formed by cutting a generally rectangular blank 30 from sheet metal, cutting the second substantially planar portion 10 of the third flange 4 in the blank 30, bending the first flange 2 up ninety degrees from the blank 30, forming the first juncture 8, and by bending the third flange 4 down ninety degrees from the blank 30, forming the second juncture 12. In addition, first and second relief holes 31 are preferably punched in the blank 30 because the second substantially planar portion 10 of the third flange 4 is preferably cut from the first relief hole 31 to the second relief hole 31. Also, fastener openings 14 are preferably punched in the blank 30 before the blank 30 is bent. And reinforcing embossments 13 are preferably formed in the blank 30 before bending. The connector 1 can also be cast from metals (e.g., aluminum), plastics (e.g., acrylonitrile butadiene styrene), composites (e.g., carbon fibre) or the like. If the connector 1 is cast, the first and second junctures 8 and 12 would be cast rather than created by bending, but would otherwise be equivalent to bends created by bending. Similarly, the outline, fastener openings 14 and embossments 13 could all be cast, rather than cut, punched and, for instance, embossed.

As shown in FIG. 2, preferably, the first substantially planar portion 9 of the third flange 4 has four sides 32. The second substantially planar portion 10 of the third flange 4 preferably has four sides 33 as well. Preferably, one of the sides 33 of the second substantially planar portion 10 is integrally joined to one of the sides 32 of the first substantially planar portion 9. The side 33 of the second substantially planar portion 10 that is integrally joined to one of the sides 32 of the first substantially planar portion 9 is preferably shorter than the side 32 of the first substantially planar portion 9 to which it is joined. Preferably, the side 33 of the second substantially planar portion 10 that is integrally joined to one of the sides 32 of the first substantially planar portion 9 has two ends 34. The side 32 of the first substantially planar portion 9, to which the side 33 of the second substantially planar portion 10 is integrally joined, extends beyond both of the ends 34 of the side 33 of the second substantially planar portion 10 is integrally joined, forming a T-shaped third flange 4.

Preferably, the connector 1 of the present invention is formed from a single piece of sheet metal, preferably steel. The steel preferably has a galvanized coating, preferably at least G90, which is a minimum of 0.90 ounce of zinc per square foot of surface area. Heavier galvanized coatings are also possible, including hot-dip galvanized, which is a minimum of 2.0 ounces of zinc per square foot of surface area. Heavier galvanized coating generally demand the use of hot-dip galvanized fasteners 23. The connector 5 can also be made from stainless steel, preferably type 316L, which requires the use of stainless steel fasteners 23.

Preferably, the embodiment of the connector 1 of the present invention, shown in FIGS. 9 through 12, having two embossments in the third flange 4 is formed from a single piece of sheet metal, preferably steel, with the following dimensions when used to connect to a hollow metal web 27 that has a second side 26 having a width dimension of approximately 1.65 inches. In the first flange 2, the distance between first edge 6 and first juncture 8 is 1.7813 inches. In the second flange 3, the distance between first juncture 8 and second juncture 12 is 1.6563 inches. In the third flange 4, the distance between second juncture 12 and first edge 11 of third flange 4 is 1.3750 inches. In the second substantially planar portion 10 of the third flange 4, the distance between ends 34 is 2 inches. In the first substantially planar portion 9 of the third flange 4, side 32 to which the side 33 of the second substantially planar portion 10 is integrally joined, extends beyond both of the ends 34 of the side 33 for 1 inch, thus the overall width of the connector 1 is 4 inches. The distance between first juncture 8 and second juncture 12, preferably varies with the dimension of the second side 26 of the web 27.

Preferably, the embodiment of the connector 1 of the present invention, shown in FIGS. 5 through 8, having one embossment in the third flange 4 is formed from a single piece of sheet metal, preferably steel, with the following dimensions when used to connect to a hollow metal web 27 that has a second side 26 having a width dimension of approximately 1.65 inches. In the first flange 2, the distance between first edge 6 and first juncture 8 is 1.7813 inches. In the second flange 3, the distance between first juncture 8 and second juncture 12 is 1.6563 inches. In the third flange 4, the distance between second juncture 12 and first edge 11 of third flange 4 is 1.3750 inches. In the second substantially planar portion 10 of the third flange 4, the distance between ends 34 is 1.5 inches. In the first substantially planar portion 9 of the third flange 4, side 32 to which the side 33 of the second substantially planar portion 10 is integrally joined, extends beyond both of the ends 34 of the side 33 for 0.875 inches, thus the overall width of the connector 1 is 3.25 inches.

I claim:

1. A connection (15) comprising:

(a) a connector (1) comprising:

(b) a first flange (2) having:

i. a first substantially planar portion (5); and ii. a first edge (6); and (c) a second flange (3) having:

i. a first substantially planar portion (7); wherein

A. said second flange (3) is angularly joined to said first flange (2) at a first juncture (8) that is at least partially opposite said first edge (6) of said first flange (2) across said first flange (2);

(d) a third flange (4) having:

i. a first substantially planar portion (9);

ii. a second substantially planar portion (10) integrally joined to said first substantially planar portion (9) in substantially the same plane as said first substantially planar portion (9), the joining of said second substantially planar portion (10) and said first substantially planar portion (9) occurring in the same plane as said second substantially planar portion (10) and said first substantially planar portion (9);

iii. a first edge (11) on said first substantially planar portion (9); and iv. a second edge (18) on said second substantially planar portion (10); wherein:

A. said first substantially planar portion (9) of said third flange (4) is angularly joined to said second flange (3) at a second juncture (12) that is at least partially opposite said first edge (11) of said third flange (4) across said first substantially planar portion (9) of said third flange (4);

B. said second juncture (12) is at least partially opposite said first juncture (8) across said second flange (3);

C. said second substantially planar portion (10) of said third flange (4) extends past said second juncture (12);

D. said second substantially planar portion (10) of said third flange (4) extends away from said first edge (11) of said third flange (4);

E. at least part of said second edge (18) of said third flange (4) is oriented in the same direction as said first edge (6) of said first flange (2), and at least part of said second edge (18) of said third flange (4) is oriented in substantially the opposite direction from said first edge (11) of said third flange (4); wherein a supporting structural member (16) is fastened to said second flange (3) and said first substantially planar portion (9) of said third flange (4); and a supported structural member (17) is fastened to said first flange (2) and said second substantially planar portion (10) of said third flange (4); said supporting structural member (16) has a top chord (19), a bottom chord (20), and at least one web member (21) extending between said top chord (19) and said bottom chord (20); said connector (1) interfaces with said web member (21) of said supporting structural member (16); said supported structural member (17) has a top chord (22), a bottom chord (23) and an end member (24) extending between said top chord (22) and said bottom chord (23); and said connector (1) interfaces with said end member (24) of said supported structural member (17); wherein F. said web member (21) of said supporting structural member (16) is part of a web (27) between said top chord (19) and said bottom chord (20) of said supporting structural member (16);

G. said web member (21) has first and second substantially planar adjacent sides (26);

H. said first side (26) of said web member (21) is within said web (27) and said second side (26) of said web member (21) faces out of said web (27);

I. said second flange (3) interfaces with and is attached to said second side (26) of said web member (21) with a plurality of fasteners;

J. said first substantially planar portion (9) of said third flange (4) interfaces with and is attached to said first side (26) of said web member (21) with a plurality of fasteners;

K. said end member (24) of said supported structural member (17) is part of a web (28) between said top chord (22) and said bottom chord (23) of said supported structural member (17);

L. said end member (24) has first and second substantially planar sides (29) and said end member (24) substantially interfaces with said second flange (3);

M. said first side (29) of said end member (24) faces out of said web (28) and said second side (29) of said end member (24) faces out of said web (28) in the opposite direction from said first side (29) of said end member (24);

N. said first flange (2) interfaces with and is attached to said first side (29) of said end member (24) with a plurality of fasteners;

O. said second substantially planar portion (10) of said third flange (4) interfaces with and is attached to said second side (29) of said end member (24) with a plurality of fasteners; and P. said first substantially planar portion (9) of said third flange (4) has four sides (32);

Q. said second substantially planar portion (10) of said third flange (4) has four sides (33);

R. one of said sides (33) of said second substantially planar portion (10) is integrally joined to one of said sides (32) of said first substantially planar portion (9);

S. said side (33) of said second substantially planar portion (10) that is integrally joined to one of said sides (32) of said first substantially planar portion (9) is shorter than said side (32) of said first substantially planar portion (9) to which it is joined;

T. said side (33) of said second substantially planar portion (10) that is integrally joined to one of said sides (32) of said first substantially planar portion (9) has two ends (34);

U. said side (32) of said first substantially planar portion (9), to which said side (33) of said second substantially planar portion (10) is integrally joined, extends beyond both of said ends (34) of said side (33) of said second substantially planar portion (10);

V. at least two of the plurality of fasteners in said second flange (3) are separated by a distance greater than the distance between said ends (34) of said side (33) of said second substantially planar portion (10);

W. at least two of the plurality of fasteners in said first flange (2) are separated by a distance greater than the distance between said ends (34) of said side (33) of said second substantially planar portion (10);

X. at least two of the plurality of fasteners in said first substantially planar portion (9) of said third flange (4) are separated by a distance greater than the distance between said ends (34) of said side (33) of said second substantially planar portion (10); and Y. wherein no flange coplanar with said first flange (2) extends past said first juncture (8).

2. The connection (15) of claim 1, wherein:

(a) said supporting structural member (16) and said supported structural member (17) are made primarily of metal.

3. The connection (15) of claim 2, wherein:

(a) said supporting structural member (16) and said structural member (17) are made primarily of hollow steel.

4. The connection (15) of claim 3, wherein:

(a) said supporting structural member (16) and said supported structural member (17) are fastened to said connector (1) with separate fasteners (25).

5. The connection (15) of claim 4, wherein:

(a) said separate fasteners (25) are screws (25) and said second flange (3) interfaces with and is attached to said second side (26) of said web member (21) with said plurality of screws (25) driven orthogonally to said planar portion (7) of said second flange (3);

(b) said first substantially planar portion (9) of said third flange (4) interfaces with and is attached to said first side (26) of said web member (21) with said plurality of screws (25) driven orthogonally to said first planar portion (9) of said third flange (4);

(c) said first flange (2) interfaces with and is attached to said first side (29) of said end member (24) with said plurality of screws (25) driven orthogonally to said planar portion (5) of said first flange (2);

(d) said second substantially planar portion (10) of said third flange (4) interfaces with and is attached to said second side (29) of said end member (24) with said plurality of screws (25) driven orthogonally to said second planar portion (10) of said third flange (4).

6. The connection of claim 1, wherein:

(a) said first flange (2) has at least one reinforcing embossment (13).

7. The connection of claim 6, wherein:

(a) said third flange (4) has at least one reinforcing embossment (13).

8. The connection of claim 7, wherein:

(a) said at least one reinforcing embossment (13) in said first flange (2) is elongated and oriented substantially perpendicular to said first juncture (8).

9. The connection of claim 8, wherein:

(a) said at least one reinforcing embossment (13) in said third flange (4) is elongated, oriented substantially perpendicular to said second juncture (12), and spans from said first substantially planar portion (9) of said third flange (4) to said second substantially planar portion (10) of said third flange (4).

10. The connection of claim 9, wherein:

(a) said second flange (3) is orthogonal to said first flange (2) and to said third flange (4); and (b)said first flange (2) and said third flange (4) occupy substantially parallel planes.

11. A method of forming a connection (15), comprising:

(a) providing a connector (1), said connector comprising:

(b) a first flange (2) having :

i. a first substantially planar portion (5); and ii. a first edge (6); and (c) a second flange (3) having:

i. a first substantially planar portion (7); wherein

A. said second flange (3) is angularly joined to said first flange (2) at a first juncture (8) that is at least partially opposite said first edge (6) of said first flange (2) across said first flange (2);

(d) a third flange (4) having:

i. a first substantially planar portion (9);

ii. a second substantially planar portion (10) integrally joined to said first substantially planar portion (9) in substantially the same plane as said first substantially planar portion (9), the joining of said second substantially planar portion (10) and said first substantially planar portion (9) occurring in the same plane as said second substantially planar portion (10) and said first substantially planar portion (9);

iii. a first edge (11) on said first substantially planar portion (9); and iv. a second edge (18) on said second substantially planar portion (10); wherein:

A. said first substantially planar portion (9) of said third flange (4) is angularly joined to said second flange (3) at a second juncture (12) that is at least partially opposite said first edge (11) of said third flange (4) across said first substantially planar portion (9) of said third flange (4);

B. said second juncture (12) is at least partially opposite said first juncture (8) across said second flange (3);

C. said second substantially planar portion (10) of said third flange (4) extends past said second juncture (12);

D. said second substantially planar portion (10) of said third flange (4) extends away from said first edge (11) of said third flange (4);

E. at least part of said second edge (18) of said third flange (4) is oriented in the same direction as said first edge (6) of said first flange (2), and at least part of said second edge (18) of said third flange (4) is oriented in substantially the opposite direction from said first edge (11) of said third flange (4);

(e) providing a supporting structural member (16) and a supported structural member (17); said supporting structural member (16) has a top chord (19), a bottom chord (20), and at least one web member (21) extending between said top chord (19) and said bottom chord (20); said connector (1) interfaces with said web member (21) of said supporting structural member (16); said supported structural member (17) has a top chord (22), a bottom chord (23) and an end member (24) extending between said top chord (22) and said bottom chord (23); and said connector (1) interfaces with said end member (24) of said supported structural member (17); wherein i. said web member (21) of said supporting structural member (16) is part of a web (27) between said top chord (19) and said bottom chord (20) of said supporting structural member (16);

ii. said web member (21) has first and second substantially planar adjacent sides (26);

iii. said first side (26) of said web member (21) is within said web (27) and said second side (26) of said web member (21) faces out of said web (27);

iv. said second flange (3) interfaces with said second side (26) of said web member (21);

v. said first substantially planar portion (9) of said third flange (4) interfaces with said first side (26) of said web member (21);

vi. said end member (24) of said supported structural member (17) is part of a web (28) between said top chord (22) and said bottom chord (23) of said supported structural member (17);

vii. said end member (24) has first and second substantially planar sides (29) and said end member (24) substantially interfaces with said second flange (3);

viii. said first side (29) of said end member (24) faces out of said web (28) and said second side (29) of said end member (24) faces out of said web (28) in the opposite direction from said first side (29) of said end member (24);

ix. said first flange (2) interfaces with said first side (29) of said end member (24);

x. said second substantially planar portion (10) of said third flange (4) interfaces with said second side (29) of said end member (24), (f) driving a plurality of screws (25) through said second flange (3) into said supporting structural member (16);

(g)driving a plurality of screws (25) through said first substantially planar portion (9) of said third flange (4) into said supporting structural member (16);

(h)driving a plurality of screws (25) through said first flange (2) into said supported structural member (17); and (i) driving a plurality of screws (25) through said second substantially planar portion (10) of said third flange (4) into said supported structural member (17); and wherein (j) said first substantially planar portion (9) of said third flange (4) has four sides (32);

(k)said second substantially planar portion (10) of said third flange (4) has four sides (33);

(l) one of said sides (33) of said second substantially planar portion (10) is integrally joined to one of said sides (32) of said first substantially planar portion (9);

(m) said side (33) of said second substantially planar portion (10) that is integrally joined to one of said sides (32) of said first substantially planar portion (9) is shorter than said side (32) of said first substantially planar portion (9) to which it is joined;

(n) said side (33) of said second substantially planar portion (10) that is integrally joined to one of said sides (32) of said first substantially planar portion (9) has two ends (34);

(o) said side (32) of said first substantially planar portion (9), to which said side (33) of said second substantially planar portion (10) is integrally joined, extends beyond both of said ends (34) of said side (33) of said second substantially planar portion (10);

(p) at least two of the plurality of screws (25) in said second flange (3) are separated by a distance greater than the distance between said ends (34) of said side (33) of said second substantially planar portion (10);

(q) at least two of the plurality of screws (25) in said first flange (2) are separated by a distance greater than the distance between said ends (34) of said side (33) of said second substantially planar portion (10);

(r) at least two of the plurality of screws (25) in said first substantially planar portion (9) of said third flange (4) are separated by a distance greater than the distance between said ends (34) of said side (33) of said second substantially planar portion (10); and (s) wherein no flange coplanar with said first flange (2) extends past said first juncture (8).

12. The connection of claim 11, wherein:

(a) said supporting structural member (16) and said supported structural member (17) are made primarily of hollow steel and said second flange (3) interfaces with and is attached to said second side (26) of said web member (21) with said plurality of screws (25) driven orthogonally to said planar portion (7) of said second flange (3);

(b) said first substantially planar portion (9) of said third flange (4) interfaces with and is attached to said first side (26) of said web member (21) with said plurality of screws (25) driven orthogonally to said first planar portion (9) of said third flange (4);

(c) said first flange (2) interfaces with and is attached to said first side (29) of said end member (24) with said plurality of screws (25) driven orthogonally to said planar portion (5) of said first flange (2);

(d)said second substantially planar portion (10) of said third flange (4) interfaces with and is attached to said second side (29) of said end member (24) with said plurality of screws (25) driven orthogonally to said second planar portion (10) of said third flange (4).

* * * * *